US009249691B2

(12) United States Patent
Ast et al.

(10) Patent No.: US 9,249,691 B2
(45) Date of Patent: Feb. 2, 2016

(54) SYSTEMS AND METHODS FOR COLD STARTUP OF RANKINE CYCLE DEVICES

(75) Inventors: Gabor Ast, Munich (DE); Herbert Kopecek, Schwaz (AT); Simon Schoewel, Moosthenning (DE)

(73) Assignee: General Electric Company, Niskayuna, NY (US)

( * ) Notice: Subject to any disclaimer, the term of this patent is extended or adjusted under 35 U.S.C. 154(b) by 305 days.

(21) Appl. No.: 13/344,679

(22) Filed: Jan. 6, 2012

(65) Prior Publication Data

US 2013/0174550 A1 Jul. 11, 2013

(51) Int. Cl.

| | |
|---|---|
| ***F01K 13/02*** | (2006.01) |
| ***F01K 21/06*** | (2006.01) |
| ***F01K 27/00*** | (2006.01) |
| ***F03G 7/00*** | (2006.01) |
| ***B01D 19/00*** | (2006.01) |
| ***F01B 31/00*** | (2006.01) |
| ***F01K 19/00*** | (2006.01) |
| ***F01K 25/08*** | (2006.01) |

(52) U.S. Cl.

CPC ..... *F01K 25/08* (2013.01); *F01K 13/02* (2013.01)

(58) Field of Classification Search

CPC ..... F01D 19/02; F01D 25/10; F01K 3/22; F01K 7/40; F01K 13/02; F01K 25/08; F01K 25/10; F22B 35/14; Y02E 20/12; Y02E 20/14; Y02E 20/16; Y02E 20/18

USPC ..... 60/641.1, 641.2, 645, 646, 653, 679, 60/39.182, 649, 651, 654, 657, 39.41

See application file for complete search history.

(56) References Cited

U.S. PATENT DOCUMENTS

| | | | | |
|---|---|---|---|---|
| 3,370,420 | A * | 2/1968 | Johnson | 60/649 |
| 3,518,830 | A * | 7/1970 | Dunnavant et al. | 60/657 |
| 4,090,362 | A * | 5/1978 | Bourque | 60/679 |
| 4,793,132 | A | 12/1988 | Okabe | |
| 5,267,434 | A * | 12/1993 | Termuehlen et al. | 60/39.182 |
| 6,422,017 | B1 * | 7/2002 | Bassily | 60/653 |
| 6,751,959 | B1 * | 6/2004 | McClanahan et al. | 60/651 |
| 6,948,315 | B2 * | 9/2005 | Kirby et al. | 60/653 |

(Continued)

FOREIGN PATENT DOCUMENTS

| | | |
|---|---|---|
| DE | 10116387 A1 | 10/2002 |
| EP | 1500792 A2 | 1/2005 |

(Continued)

OTHER PUBLICATIONS

Zhao, Zhibo, et al., Turbine Inlet Parameters' Effect on Diesel Waste Heat Recovery by Organic Rankine Cycle, Abstract, Jul. 2011, 1 page, ISBN: 978-1-4244-9436-1.

(Continued)

*Primary Examiner* — Jorge Pereiro
*Assistant Examiner* — Daniel Wagnitz
(74) *Attorney, Agent, or Firm* — Pabrita K. Chakrabarti

(57) ABSTRACT

A Rankine cycle device includes a heat exchanger for supplying heat to a working fluid and an expansion device for expanding the working fluid. A valve is disposed between the heat exchanger and the expansion device and a cooling device is reduces a temperature of the working fluid. A pump moves the working fluid through the Rankine cycle device and a sensor is used to sense a pressure of the working fluid. A controller is operable to open the valve based upon the sensed pressure of the working fluid.

14 Claims, 2 Drawing Sheets

(56) References Cited

U.S. PATENT DOCUMENTS

| | | | | |
|---|---|---|---|---|
| 7,040,095 | B1 | 5/2006 | Lang | |
| 7,096,665 | B2 * | 8/2006 | Stinger et al. | 60/651 |
| 7,318,316 | B2 * | 1/2008 | Yamada | 60/653 |
| 8,091,361 | B1 * | 1/2012 | Lang | 60/654 |
| 2004/0074465 | A1 | 4/2004 | Hunt et al. | |
| 2005/0072156 | A1 | 4/2005 | Tsutsui et al. | |
| 2007/0044473 | A1 | 3/2007 | Yatsuzuka et al. | |
| 2007/0295290 | A1 | 12/2007 | Cao | |
| 2008/0250789 | A1 | 10/2008 | Myers et al. | |
| 2011/0138809 | A1 | 6/2011 | Ramaswamy et al. | |
| 2011/0146277 | A1 | 6/2011 | Kopecek et al. | |

FOREIGN PATENT DOCUMENTS

| | | | |
|---|---|---|---|
| EP | 2143891 | A2 | 1/2010 |
| EP | 2345797 | A2 | 7/2011 |
| WO | 2009016029 | A2 | 2/2009 |

OTHER PUBLICATIONS

Search Report and Written Opinion from corresponding EP Application No. 13150273.4-1610 dated Mar. 25, 2013.

* cited by examiner

SYSTEMS AND METHODS FOR COLD STARTUP OF RANKINE CYCLE DEVICES

BACKGROUND OF THE INVENTION

The field of the present disclosure relates generally to Rankine cycle devices. More particularly, the present disclosure relates to systems and methods for cold startup of Rankine cycle devices.

Rankine cycle devices use a working fluid in a closed-loop cycle to gather heat from a heating source, or a heat reservoir, by generating a hot gaseous stream. The hot gaseous stream is expanded through a turbine to generate power, typically electrical power. The expanded stream is then condensed in a condenser by transferring heat from the expanded stream to a cold reservoir. The working fluid remains in a closed loop and is repeatedly sent through the Rankine cycle.

The efficiency of Rankine cycle devices, such as Organic Rankine Cycle (ORC) devices, in a low-temperature heat recovery application is sensitive to temperatures of the hot and cold reservoirs between which they operate. In an ORC device, the working fluid is an organic, high molecular mass fluid with a liquid-vapor phase change, or boiling point, occurring at a lower temperature than the water-steam phase change point. Typically, the temperatures of the reservoirs change significantly during the lifetime of the plant. Geothermal plants, for example, may be designed for a particular temperature of a geothermal heating fluid from the earth, but lose efficiency as the ground fluid cools over time. Air-cooled ORC plants that use an exhaust at a constant temperature from a larger plant as heating fluid deviate from their designed operating conditions as outside air temperature changes.

Typically, ORC plant designs encounter unreliable cold startup conditions because the working fluid condenses and settles inside the loop, rather than in the feed vessel, after the ORC plant shuts down. Plant start-up thus may become difficult, or fail altogether, with the working fluid blocking the expansion device during cold startup conditions.

BRIEF DESCRIPTION OF THE INVENTION

In one aspect a Rankine cycle device includes a heat exchanger configured to supply heat to a working fluid and an expansion device configured to expand the working fluid. A valve is disposed between the heat exchanger and the expansion device and a cooling device is configured to reduce a temperature of the working fluid. A pump is configured to flow the working fluid through the Rankine cycle device and a sensor is configured to sense a pressure of the working fluid. A controller is configured to open the valve based upon the sensed pressure of the working fluid.

In another aspect a method of operating a Ranking Cycle device includes closing a valve to prevent a working fluid contained within the device from entering an expansion device and heating a working fluid contained within the Rankine cycle device until the working fluid reaches a predetermined pressure. The valve is opened and the working fluid is supplied to a feeding vessel configured to supply the working fluid to a pump.

DETAILED DESCRIPTION OF THE INVENTION

Figure 1:
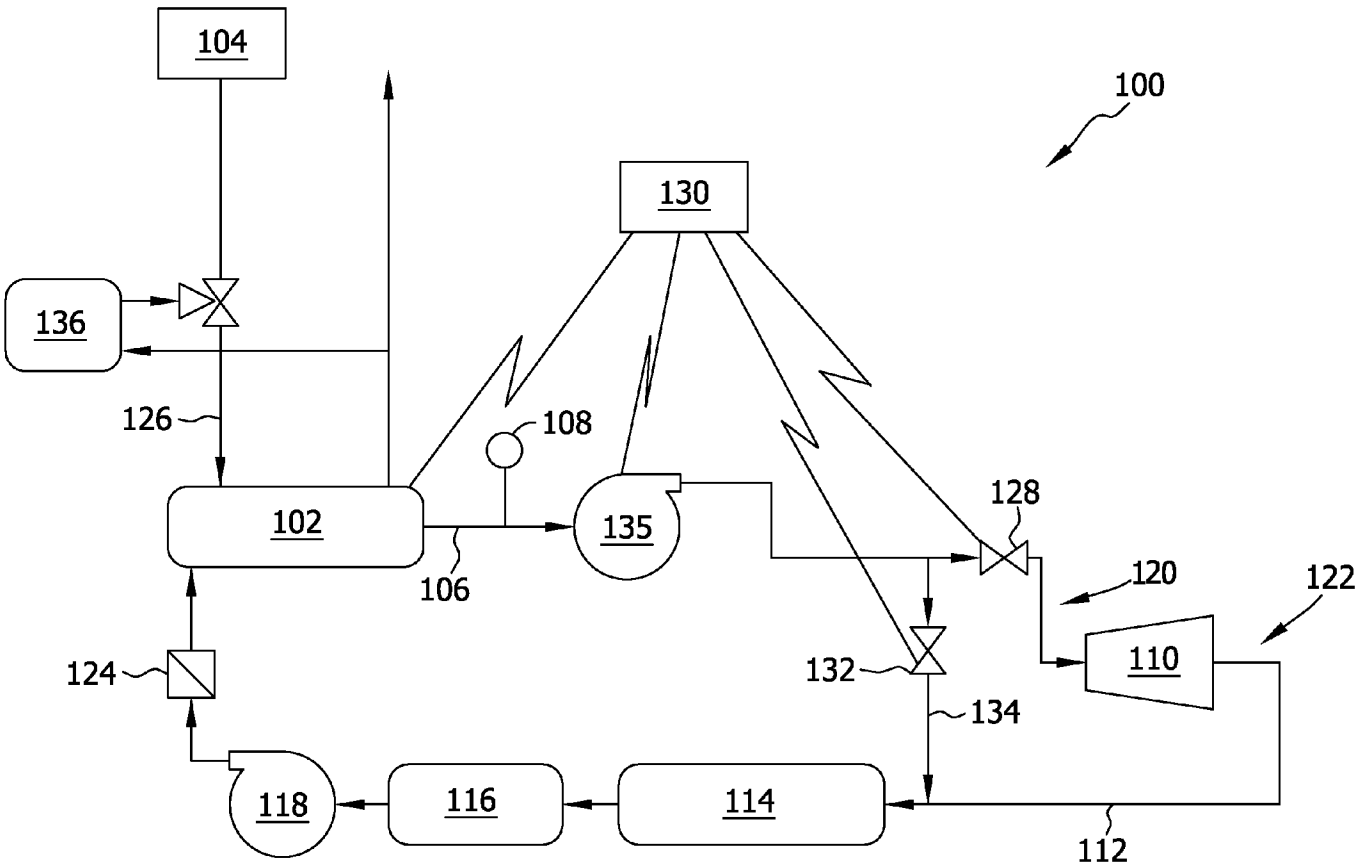
FIG. 1 is a block diagram showing an exemplary embodiment of the present disclosure.

FIG. 1 shows an exemplary embodiment of a Rankine cycle device 100 according to the present disclosure. Rankine cycle device 100 includes a heat exchanger 102 configured to receive heat from an external source 104 to heat a high pressure stream of working fluid 106. In one embodiment, the working fluid is an organic, high molecular mass fluid. A pressure sensor 108 is disposed downstream of heat exchanger 102 and senses a pressure of working fluid 106. Rankine cycle device 100 also includes an expansion device 110, such as a turbine expansion device, that allows the high pressure stream of working fluid 106 to expand to expanded stream 112. Expanded stream 112 is supplied to a cooling device 114 and a feed vessel 116. Subsequently, the feed vessel supplies working fluid to pump 118.

Upstream of expansion device 110 is a high pressure side 120 of the Rankine cycle device, and downstream of expansion device 110 is low pressure side 122. Pump 118 is configured to pump working fluid from low pressure side 122 to high pressure side 120 via a check valve 124. In one embodiment, check valve 124 is a one-way valve that allows the working fluid to pass therethrough in only one direction, for example, to prevent backflow into pump 118.

The stream of working fluid leaves pump 118 and enters heat exchanger 102. Heat exchanger 102 receives a heat input 126 from external source 104 to heat the working fluid 106. In one embodiment, heat input 126 is a hot exhaust gas from an internal combustion engine, power plant, industrial waste gas, natural thermal sources (e.g., geothermal), or solar heating. However, heat input 126 may be any heat input that allows the Rankine cycle device to operate as described herein. Heat exchanger 102 heats the working fluid at a constant pressure (i.e., isobarically) to produce a high pressure stream of working fluid 106.

High pressure stream of working fluid 106 passes through a valve 128 and enters expansion device 110 on high pressure side 120. Expansion device 110 allows the working fluid to expand therethrough until the working fluid exits expansion device 110 on low pressure side 122. In one embodiment, expansion device 110 is a turbine for a power plant, wherein expansion of the working fluid causes a rotation of the turbine to produce power, such as electrical power. Expansion of the working fluid through expansion device 110 decreases the pressure and temperature of the working fluid.

In one embodiment, expanded stream 112 of working fluid 106 is supplied to a cooling device 114. In another embodiment, cooling device 114 is a condenser, which allows the working fluid to cool into a liquid. In one embodiment, cooling device 114 is configured to cool the working fluid using ambient air. In another embodiment, cooling device receives a refrigerant from an external source (not shown) to cool the working fluid.

In one embodiment, the liquid stream exiting cooling device 114 is supplied to a feed vessel 116. Feed vessel 116 is configured to contain a quantity of working fluid such that a constant supply of working fluid may be supplied to pump 118. In one embodiment, the Rankine cycle device is a closed loop system, and pump 118 again pumps the working fluid to heat exchanger 102 and the cycle repeats.

Sometimes, it is necessary to stop the operation of a Rankine cycle device. Typically, when a Rankine cycle device is shut down, the working fluid condenses and accumulates in a location of natural fluid accumulation, such as a low-point of the Rankine cycle device. The location of natural fluid accumulation is typically within heat exchanger 102 or on high pressure side 120 of expansion device 110. Thus, typically, the working fluid accumulates outside of pump 118 and feed vessel 116, which may cause difficulty during later attempts to start up the Rankine cycle device.

In one embodiment, to improve ease of startup of Rankine cycle device 100 after a shutdown, a controller 130 is configured to close valve 128 and control heat exchanger 102 to heat the working fluid. Because valve 128 is in a closed position, heating the working fluid in heat exchanger 102 increases the pressure of the working fluid. In one embodiment, controller 130 controls heat exchanger 102 to heat the working fluid until a predetermined pressure is sensed by sensor 108. When the pressure of the working fluid reaches or exceeds the predetermined pressure level, controller 130 controls valve 128 to open abruptly, which allows for a surge of working fluid to flow from high pressure side 120 to low pressure side 122. In one embodiment, the predetermined pressure level is selected to allow for sufficient levels of working fluid to accumulate into feed vessel 116 and/or pump 118 to facilitate startup of the Rankine cycle device 100.

In another embodiment, Rankine cycle device 100 comprises a bypass valve 132. Bypass valve 132 is installed along bypass channel 134, which bypasses expansion device 110. Controller 130 is configured to close valves 128 and 132 and operate heat exchanger 102 to heat the working fluid until a predetermined pressure, and/or temperature level, of the working fluid is sensed by sensor 108. Once the predetermined pressure or temperature is met or exceeded, controller 130 sends a signal to bypass valve 132 to open, causing a surge of working fluid to flow from high pressure side 120 to low pressure side 122. In one embodiment, bypass valve 132 is opened abruptly, causing a rapid causing a surge of working fluid to flow from high pressure side 120 to low pressure side 122. In one embodiment, the predetermined pressure level is selected to allow for sufficient levels of working fluid to accumulate into feed vessel 116 and/or pump 118 to facilitate startup of the Rankine cycle device 100.

In another embodiment, a secondary pump 135 is provided on high pressure side 120. Controller 130 is configured to close valve 128 and bypass valve 132. Controller 130 operates heat exchanger 102 to heat the working fluid and controls secondary pump 135 to flow the working fluid toward closed valve 128 (e.g., using a positive displacement type secondary pump 135) until a predetermined pressure level of the working fluid is sensed by sensor 108. Once the predetermined pressure or temperature is met or exceeded, controller 130 sends a signal to bypass valve 132 (and/or valve 128) to open, causing a surge of working fluid to flow from high pressure side 120 to low pressure side 122. In one embodiment, the predetermined pressure level is selected to allow for sufficient levels of working fluid to accumulate into feed vessel 116 and/or pump 118 to facilitate startup of Rankine cycle device 100.

Figure 2:
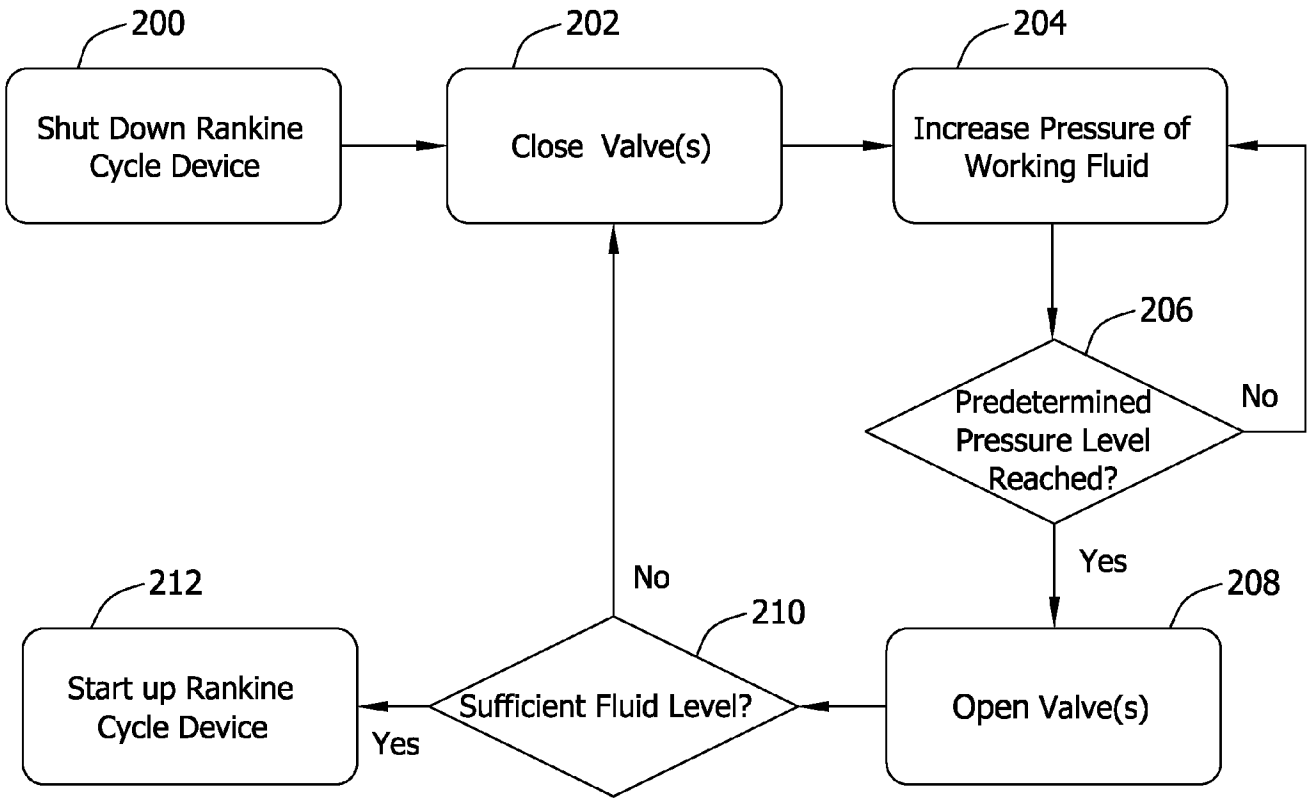
FIG. 2 is a flowchart showing an exemplary method of the present disclosure.

The above embodiments are encompassed by one or more methods. FIG. 2 shows a block diagram of a method of operating a Rankine Device according to the present disclosure. As shown in FIG. 2, the Rankine cycle device is shut down 200. During cold startup, one or more of valve 128 and bypass valve 132 are closed 204. Heat exchanger 102 and/or secondary pump 135 are operated to increase the pressure level of the working fluid. When it is determined 206 that the pressure level has met or exceed a predetermined pressure level, one or more of valve 128 and bypass valve 132 are opened 208. Fluid level in pump 118 and/or feed vessel 116 is measured at 210. If it is determined that sufficient levels of working fluid are contained with pump 118 and/or feed vessel 116, the Rankine cycle device 100 is operated to initiate startup 212. If insufficient levels of working fluid are contained with pump 118 and/or feed vessel 116, the process is repeated from step 202.

In another embodiment a secondary cooling device 136 is provided to cool heat input 126 to heat exchanger 102. Secondary cooling device 136 is operated to cool heat input 126 when it is determined that heat input 126 is at or exceeds a predetermined temperature.

Technical effects of the present disclosure allow for the possibility of one or more of controlling one or more valves and a heat exchanger to increase a pressure level of a working fluid and abruptly opening one or more valves of a Rankine cycle device to provide a surge of working fluid to a pump to facilitate startup of the device.

In some embodiments, the above described systems and methods are electronically or computer controlled. The embodiments described herein are not limited to any particular system controller or processor for performing the processing and tasks described herein. The term controller or processor, as used herein, is intended to denote any machine capable of performing the calculations, or computations, necessary to perform the tasks described herein. The terms controller and processor also are intended to denote any machine that is capable of accepting a structured input and of processing the input in accordance with prescribed rules to produce an output. It should also be noted that the phrase "configured to" as used herein means that the controller/processor is equipped with a combination of hardware and software for performing the tasks of embodiments of the invention, as will be understood by those skilled in the art. The term controller/processor, as used herein, refers to central processing units, microprocessors, microcontrollers, reduced instruction set circuits (RISC), application specific integrated circuits (ASIC), logic circuits, and any other circuit or processor capable of executing the functions described herein.

The embodiments described herein embrace one or more computer readable media, including non-transitory computer readable storage media, wherein each medium may be configured to include or includes thereon data or computer executable instructions for manipulating data. The computer executable instructions include data structures, objects, programs, routines, or other program modules that may be accessed by a processing system, such as one associated with a general-purpose computer capable of performing various different functions or one associated with a special-purpose computer capable of performing a limited number of functions. Aspects of the disclosure transform a general-purpose computer into a special-purpose computing device when configured to execute the instructions described herein. Computer executable instructions cause the processing system to perform a particular function or group of functions and are examples of program code means for implementing steps for methods disclosed herein. Furthermore, a particular sequence of the executable instructions provides an example of corresponding acts that may be used to implement such steps. Examples of computer readable media include random-access memory ("RAM"), read-only memory ("ROM"), programmable read-only memory ("PROM"), erasable programmable read-only memory ("EPROM"), electrically erasable programmable read-only memory ("EEPROM"), compact disk read-only memory ("CD-ROM"), or any other device or component that is capable of providing data or executable instructions that may be accessed by a processing system.

A computer or computing device such as described herein has one or more processors or processing units, system memory, and some form of computer readable media. By way of example and not limitation, computer readable media comprise computer storage media and communication media. Computer storage media include volatile and nonvolatile, removable and non-removable media implemented in any method or technology for storage of information such as computer readable instructions, data structures, program modules or other data. Communication media typically embody computer readable instructions, data structures, program modules, or other data in a modulated data signal such as a carrier wave or other transport mechanism and include any information delivery media. Combinations of any of the above are also included within the scope of computer readable media.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A Rankine cycle device, comprising:

a working fluid;

a heat exchanger for supplying heat to the working fluid;

an expansion device for expanding the working fluid;

a cooling device for reducing a temperature of the working fluid;

a valve disposed between said heat exchanger and said cooling device;

a pump for moving the working fluid through the Rankine cycle device;

a feed vessel disposed between the valve and the pump;

a sensor for sensing a pressure of the working fluid between the heat exchanger and the expansion device; and a controller programmed to execute the steps of:

after a shutdown of the Rankine cycle device, control a restarting of the Rankine cycle device by controlling the heat exchanger, while the valve is closed, to heat the working fluid until the pressure of the working fluid between the heat exchanger and the expansion device reaches or exceeds a predetermined pressure; and then changing a state of the valve abruptly from closed to open when the pressure of the working fluid between the heat exchanger and the expansion device reaches or exceeds the predetermined pressure to cause a surge of the working fluid to flow from the heat exchanger to the feed vessel.

2. The Rankine cycle device according to claim 1, further comprising a bypass channel for bypassing the working fluid from entering the expansion device.

3. The Rankine cycle device according to claim 2, wherein the valve is located along the bypass channel.

4. The Rankine cycle device according to claim 1, further comprising a bypass channel for bypassing the working fluid from entering the expansion device, and a second valve disposed upstream of the expansion device, wherein the valve is located along the bypass channel and the controller is further operable to close the second valve when the valve along the bypass channel is open.

5. The Rankine cycle device according to claim 1, further comprising a second pump disposed upstream of the valve in a location of natural fluid accumulation of the Rankine cycle device, and operable to increase the pressure of the working fluid.

6. A method of operating a Rankine Cycle device, comprising:

closing a valve to prevent a working fluid contained within the device from entering an expansion device after the Rankine Cycle device is shut down;

heating, with a heat exchanger, the working fluid contained within the Rankine cycle device until the working fluid reaches a predetermined pressure;

opening the valve abruptly when the working fluid reaches or exceeds the predetermined pressure, during a restarting of the Rankine Cycle device to cause a surge of the working fluid to flow from the heat exchanger to a feeding vessel for supplying the working fluid to a pump;

comparing a fluid level in the feeding vessel with a predetermined level of the working fluid in the feeding vessel; and repeating the closing, the heating and the opening until the predetermined level of fluid in the feeding vessel is sensed.

7. The method according to claim 6, wherein opening the valve comprises bypassing the expansion device.

8. The method according to claim 6, further comprising using a pressure sensing device to sense the pressure of the working fluid at a location between the heat exchanger and the valve.

9. The method according to claim 6, further comprising comparing a sensed temperature to a predetermined temperature, and opening the valve comprises opening the valve after determining the sensed temperature is at or above the predetermined temperature.

10. The method according to claim 6, further comprising passing the working fluid through a cooling device before supplying the fluid to the pump.

11. The method according to claim 6, further comprising operating a second pump to increase the pressure of the working fluid prior to opening the valve.

12. The method according to claim 11, further comprising providing the pump at a location of natural fluid accumulation of the Rankine cycle device.

13. The method according to claim 6, wherein heating the working fluid comprises heating the working fluid in a heat exchanger.

14. The method according to claim 13, further comprising using an exhaust gas to supply heat to the heat exchanger.

* * * * *